US008356865B2

(12) United States Patent
Laible

(10) Patent No.: US 8,356,865 B2
(45) **Date of Patent: *Jan. 22, 2013**

(54) REFRIGERATING DEVICE WITH PULL-OUT CARRIER FOR REFRIGERATED GOODS

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 808 days.

This patent is subject to a terminal disclaimer.

(21) Appl. No.: 11/918,820

(22) PCT Filed: Apr. 3, 2006

(86) PCT No.: PCT/EP2006/061276

§ 371 (c)(1),
(2), (4) Date: Nov. 17, 2008

(87) PCT Pub. No.: WO2006/120085

PCT Pub. Date: Nov. 16, 2006

(65) Prior Publication Data

US 2009/0217697 A1 Sep. 3, 2009

(30) Foreign Application Priority Data

May 10, 2005 (DE) ..... 10 2005 021 558

(51) Int. Cl.
*A47B 88/04* (2006.01)

(52) U.S. Cl. ..... 312/404; 312/334.1; 312/334.8

(58) Field of Classification Search ..... 312/330.1, 312/334.1, 334.7, 334.8, 334.11, 334.22, 312/350, 351, 401, 402, 404, 407, 408; 62/382, 62/440; 384/18, 20, 22

See application file for complete search history.

(56) References Cited

U.S. PATENT DOCUMENTS

| | | | | | |
|---|---|---|---|---|---|
| 1,837,293 | A | * | 12/1931 | Sanford | 312/408 |
| 2,318,363 | A | | 5/1943 | Boddy | |
| 2,711,944 | A | * | 6/1955 | Meek et al. | 312/333 |
| 3,320,003 | A | * | 5/1967 | Edelson et al. | 384/35 |
| 3,650,578 | A | * | 3/1972 | Del Vecchio et al. | 384/18 |
| 4,993,847 | A | * | 2/1991 | Hobbs | 384/21 |
| 5,015,047 | A | | 5/1991 | Nock | |
| 5,020,869 | A | * | 6/1991 | Faust | 312/334.15 |
| 5,033,805 | A | * | 7/1991 | Hobbs | 312/334.11 |
| 5,040,856 | A | * | 8/1991 | Wilkins et al. | 312/402 |

(Continued)

FOREIGN PATENT DOCUMENTS

DE 299 04 760 U 6/1999

(Continued)

OTHER PUBLICATIONS

International Search Report PCT/EP2006/061276.

*Primary Examiner* — James O Hansen
*Assistant Examiner* — Sasha T Varghese
(74) *Attorney, Agent, or Firm* — James F. Howard; Andre Pallapies

(57) ABSTRACT

The invention relates to a refrigerator having two telescopic extensions. A carrier for refrigerated goods is held on each telescopic extension by an adapter that bridges the space between the carrier for refrigerated goods and the telescopic extension, the width of the space being at least equal to the width of the telescopic extension.

19 Claims, 4 Drawing Sheets

U.S. PATENT DOCUMENTS

| | | | | |
|---|---|---|---|---|
| 5,536,083 | A * | 7/1996 | Brustle et al. | 312/334.6 |
| 5,556,183 | A * | 9/1996 | Brustle et al. | 312/348.1 |
| 5,570,942 | A * | 11/1996 | Vonier | 312/334.6 |
| 5,641,216 | A * | 6/1997 | Grass | 312/334.27 |
| 6,474,761 | B1 * | 11/2002 | Muterthies et al. | 312/348.1 |
| 6,478,393 | B2 * | 11/2002 | Kim et al. | 312/334.12 |
| 7,980,643 | B2 * | 7/2011 | Laible | 312/404 |
| 2003/0173882 | A1 * | 9/2003 | Koons | 312/404 |
| 2008/0191589 | A1 * | 8/2008 | Dorner et al. | 312/116 |
| 2009/0066207 | A1 * | 3/2009 | Laible | 312/404 |
| 2009/0071186 | A1 * | 3/2009 | Laible | 62/448 |
| 2009/0079312 | A1 * | 3/2009 | Laible | 312/334.27 |
| 2010/0019637 | A1 * | 1/2010 | Guttinger | 312/334.5 |

FOREIGN PATENT DOCUMENTS

| | | |
|---|---|---|
| EP | 0 972 468 | 1/2000 |
| WO | WO 2005/116550 | 12/2005 |
| WO | WO 2006/048307 | 5/2006 |

* cited by examiner

REFRIGERATING DEVICE WITH PULL-OUT CARRIER FOR REFRIGERATED GOODS

The present invention relates to a refrigerator with a cooling chamber in which a carrier for refrigerated goods is able to be moved with the aid of telescopic extensions. The use of telescopic extensions for movable suspension of refrigerated goods carriers, which can involve baskets, trays or similar, in a refrigerator is generally known. This type of telescopic extension generally involves two rails which engage with each other, which can be moved in relation to each other in the longitudinal direction, by a roller attached to the first rail rolling along the other rail in each case.

BACKGROUND OF THE INVENTION

To guarantee a linear guidance of the rails the two must be spaced from each other at least two points in their longitudinal direction. The distance between these two points becomes smaller the further the rails are withdrawn from one another, so that the stability of the telescopic rail suspension reduces the further a refrigerated goods carrier suspended on it is pulled out of the cooling chamber of the refrigerator. It is thus necessary to limit the movability of the rails so that the support points do not come too close to each other. The freedom of movement of the rails is thus generally significantly smaller than their length. Therefore it is also not possible, with a simple telescopic extension constructed from two rails, to make the freedom of movement of the refrigerated goods carrier large enough to enable it to be pulled out of the refrigerator compartment completely.

To achieve this objective, telescopic extensions with at least three rails able to be moved against each other are needed. These are far more expensive than those with two rails. It is thus not cost effective for a manufacturer wishing to offer a wide range of prices and equipment to use telescopic extensions with three rails throughout the range. If however both extensions with two rails and those with three or more rails are offered in the manufacturer's model range, the problem then arises of the different types of telescopic extensions requiring different amounts of space. Since the exterior dimensions of the refrigerators are predetermined in grid stages and there is also little variation in their wall thicknesses, account must be taken of the different space requirements of the different types of telescopic extension in the construction of the refrigerated goods carriers, i.e. for different models of refrigerators which differ in the type of extensions used, different refrigerated goods carriers will be needed. These must therefore be produced in a plurality of types in comparatively low volumes, which makes manufacturing more expensive.

SUMMARY OF THE INVENTION

The object of the present invention is to minimize the number of different parts needed for the manufacturing of different refrigerator models, both those with a completely withdrawable refrigerated goods carrier and also those with a carrier that can only be partly withdrawn.

The object is achieved according to the invention by a refrigerator with a cooling chamber in which a first refrigerated goods carrier is able to be moved with the aid of two telescopic rails, with the first refrigerated goods carrier being held with the aid of at least one adapter spanning the distance between refrigerated carrier and telescopic extension and with the width of the distance being at least the same as the width of the telescopic extension. This makes it possible, when the adapter is left out, to mount a further telescopic extension in series with the aforementioned telescopic extension and to support the refrigerated goods carrier on this further adapter, without the shape of the refrigerated goods carrier needing to be adapted.

To simplify the mounting of the refrigerated goods carrier in the refrigerator, the adapters are preferably to be provided with latching elements for latching to a complementary latching element of the refrigerated goods carrier in each case.

It is further preferred for the adapters to have a front and a rear latching element in each case, with the rear element able to be latched with the complementary latching element of the first refrigerated goods carrier by a movement essentially in parallel to the direction of movement of the first refrigerated goods carrier and the front element with a complementary latching element of the first refrigerated goods carrier by a movement essentially perpendicular to the direction of movement of the first refrigerated goods carrier. This means that the first latching elements prevents unlatching if the refrigerated goods carrier is only pulled in the horizontal direction to pull it out of the cooling chamber. Installing the refrigerated goods carrier is a simple matter in that first of all the rear of the refrigerated goods carrier, initially held at an angle, is pushed horizontally to make the rear latching element latch, and then the front area is lowered to latch the front area as well.

To this end the rear latching element can expediently be embodied as rigid head cut away at the rear and the complementary latching element of the refrigerated goods carrier as an open-edged slit in the direction of movement.

The front latching element by contrast is preferably a head able to be flexibly deformed in each case on latching and unlatching of the complementary latching element.

This head can be provided with a flexible edge in the direction of movement which in the latched state holds the complementary latching element of the refrigerated goods carrier against a stop in order to hold the refrigerated goods carrier on the telescopic extension without any play. If the complementary latching element of the refrigerated goods carrier is a hole in which the head engages the stop can be formed by an edge of the head facing away from said flexible edge.

Preferably the front and the rear latching element are separated from each other in each case and formed on a front or a rear adapter respectively of each telescopic extension. This two-part design allows the same adapter to be used on both a right-hand and also a left-hand telescopic extension or also to be used on telescopic extensions of different length.

In this case it is further preferred that front and rear adapter each have a plane of symmetry perpendicular to the direction of movement of the refrigerated goods carrier so that the two front adapters mounted on the right-hand or the left-hand telescopic extension or the two rear adapters mounted on the right-hand and left-hand telescopic extension lie opposite each other as mirror images.

The freedom of movement of two rails of each telescopic extension able to be moved against each other is preferably restricted to less than two thirds of their length. A greater freedom of movement would basically be able to be achieved but the torque arising in the maximum extended state between the rails would demand a high degree of rigidity of the rails and thereby cause a significant outlay in material, increasing its cost. Such the large freedom of movement of the individual telescopic extension is not required within the framework of the present invention since in order to achieve a greater freedom of movement two telescopic extensions connected in series will preferably be used.

Refrigerated goods carriers held via individual telescopic extensions and refrigerated goods carriers held via telescopic extensions connected in series can be combined in one and the same refrigerator.

The shape and arrangement of the complementary latching elements of the two refrigerated goods carriers are preferably the same in such a case. This makes it possible for example to fit at least one of the two refrigerated goods carriers at the location of the other.

To simplify manufacturing it can be worthwhile to form each refrigerated goods carrier as a multi-part unit comprising a base unit and two carrier sections attached to the base unit with the complementary latching elements being formed on the carrier sections. In particular this makes it possible to form the base unit from metal whereas the carrier sections can be formed by injection molding for example.

To guarantee that there is little play in the guidance of the refrigerated goods carrier the two rails of each telescopic extension are preferably guided with the aid of linear ball-bearings to allow movement in relation to each other.

BRIEF DESCRIPTION OF THE DRAWINGS

Further features and advantages of the invention emerge from the description of exemplary embodiments given below which refer to the enclosed figures. The figures show.

DETAILED DESCRIPTION OF THE EXEMPLARY EMBODIMENTS OF THE PRESENT INVENTION

Figure 1:
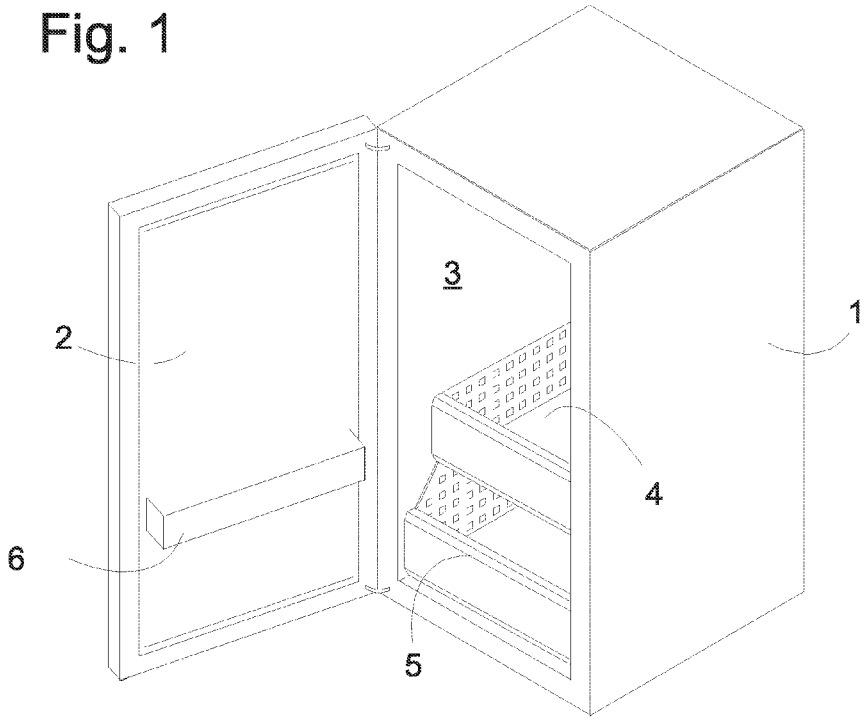
FIG. 1 a perspective view of a refrigerator on which the present invention is realized.

FIG. 1 shows a perspective view of a refrigerator with a body 1 and a door 2. In a cooling chamber 3 within the device two refrigerated goods carriers 4, 5 in the form of pull-out containers are shown by way of example. The pull-out containers are held on telescopic extensions not visible in the figure, suspended on the side walls of the body 1 to allow movement. The upper pull-out container 4 has a smaller depth than the lower container 5 to leave space for a door tray 6 attached to the door 2.

FIG. 1 shows a perspective view of a refrigerator with a body 1 and a door 2. In a cooling chamber 3 within the device two refrigerated goods carriers 4, 5 in the form of pull-out containers are shown by way of example. The pull-out containers are held on telescopic extensions not visible in the figure, suspended on the side walls of the body 1 to allow movement. The upper pull-out container 4 has a smaller depth than the lower container 5 to leave space for a door tray 6 attached to the door 2.

The upper area of the refrigerated compartment 3 left empty in the figure can accommodate further refrigerated goods containers, as required in the form of further pull-out containers or in the form of stationery or moveable shelves.

Figure 2:
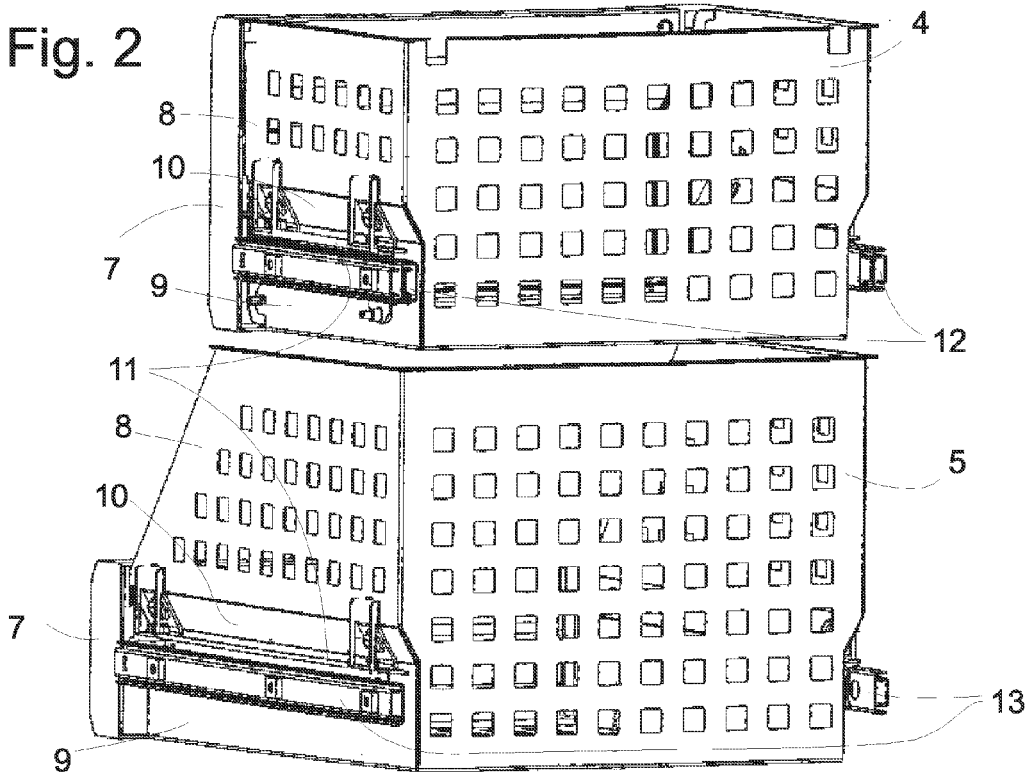
FIG. 2 a perspective view of two refrigerated goods carriers of the refrigerator from FIG. 1.

FIG. 2 shows the two pull-out containers 4, 5 in a perspective view seen from their rear. The pull-out containers 4, 5 each consist of a basket formed from perforated metal of which the front side facing the door is covered by a plastic shield 7. This shield 7 extents for the upper pull-out container 4 over its entire height, for the lower pull-out basket only across a part of the height, so that between the shield 7 and the basket lying above it a grip opening is formed as depicted in FIG. 1.

The side walls of the baskets each have vertical upper and lower wall sections 8 or 9 and angled shoulders 10 between these which run downwards towards each other in each case. An injection-molded plastic carrier part 11 is attached to the shoulders in each case, which can be seen in greater detail in FIGS. 4, 8 and 9. The carrier parts 11 in their turn are supported via adapters on telescopic extensions 12 or 13.

Figure 3:
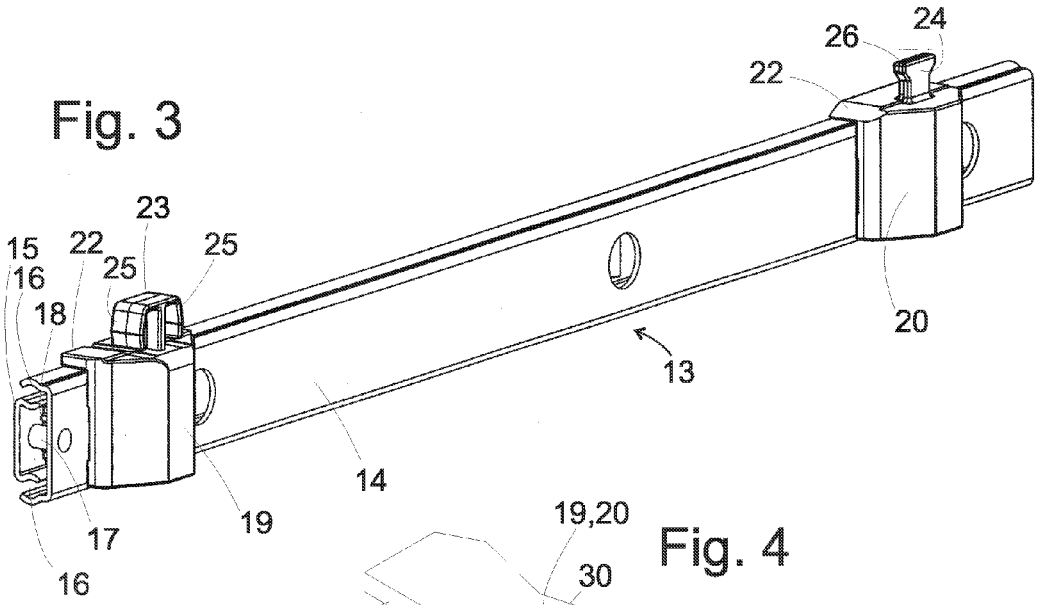
FIG. 3 a perspective view of a left-hand telescopic extension of the lower refrigerated goods carrier.

The telescopic extensions 13 on which the lower pull-out container 5 is supported each feature a pair of rails engaging with each other. The freedom of movement of these rails in relation to each other amounts to between 50 and 80% of their length; Here it is the same as the depth of the pull-out container 4 lying above it so that the pull-out container 5 in its extended position pulled out to the stop can be completely pulled out below the container 4 lying above and there is free access to its entire upper side FIG. 3 shows a perspective view of one of the telescopic extensions 13 of the lower pull-out container 5 and shows the left-hand extension 13 from the perspective of an observer looking from within the cooling chamber 3. The extension comprises two rails bent from steel sheet, an outer rail 14 of an approximately C-shaped cross section and an inner rail 15 engaging in the hollow space of the outer rail 14. Opposite arms of the rails 14, 15 delimit two cylindrical channels 16 in which a number of balls not visible in the figure are accommodated in each case which guide the movement of the rails 14, 15 with little play and easily in relation to each other. A bolt 17 protrudes from the front end of the outer rail 14 into the space between the rails 14, 15. Its contact with a rubber buffer 18 attached to the inner, rail 15, also not visible in the figure, defines a limit of the freedom of movement of the rails 14, 15 in relation to each other.

A front adapter 19 and a rear adapter 20 made of plastic are attached to the outer rails 14. The adapters 19, 20 here each have a base unit shaped something like the stump of a prism on which, on its upper side, a horizontal bar 22 resting against the upper arm of the rail 14 is formed.

A latching element 23 or 24 protrudes from the upper side of the base unit in each case. The latching element 23 of the front adapter 19 has a section roughly in the shape of a letter T, with two elastic arms 25 running downwards initially away from each other then back towards each other being formed at the ends of the crossbar of the T. The latching element 24 of the rear adapter 20 is a rigid peg which at its upper end has a forward-facing nose 26.

Figure 4:
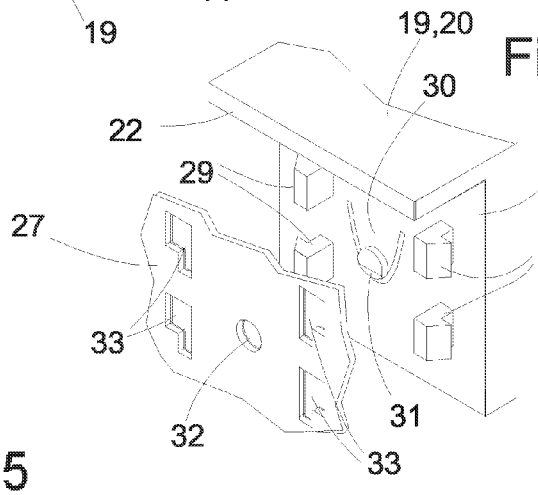
FIG. 4 fragments of a telescopic extension rail and an adapter respectively which illustrate how the adapter is attached to the rail.

FIG. 4 is intended to illustrate the anchorage of the adapters 19, 20 on the rails 14. Shown and separated from each other in each case, are a fragment 27 of the rails 14 and a side of an adapter 19 or 20 facing towards this, with the type of anchorage off the two adapters 19, 20 being the same. The wall 28 of the adapter facing towards the fragment 27 bears 4 rigid latching hooks 29 and an elastic tongue 30 formed from a U-shaped or V-shaped slit cut out of the wall 28, at the tip of which a wedge 31 protrudes. Opposite these lie a round hole 32 and four angled holes 33 of the rail 14, the latter each in the form of a rectangle which is extended at its lower edge by a short slit. To anchor the adapters 19 or 22 to the rail 14 the latching hooks 29 are introduced into the angled holes 33 and at the same time the tongue 30 D wedge of which comes up against the enclosed wall of the rail 14, is initially forced back into the hollow base unit of the adapter. If the latching hooks 29 are pushed fully through the holes 33 and the wall 28 of the adapter is resting on the rail 14 or the adapter can be pushed downwards so that the shafts of the latching hooks 29 fit into the slits of the holes 33 and the bar 22 comes to rest on the upper arm of the rail 14. In this case the wedge 31 meets the round hole 32 and snaps into the latter. Once this has occurred the adapter can only be released again from the rail 14 by first pushing the wedge 31 out of the hole 32 again using a tool and then lifting the adapter.

Figure 5:
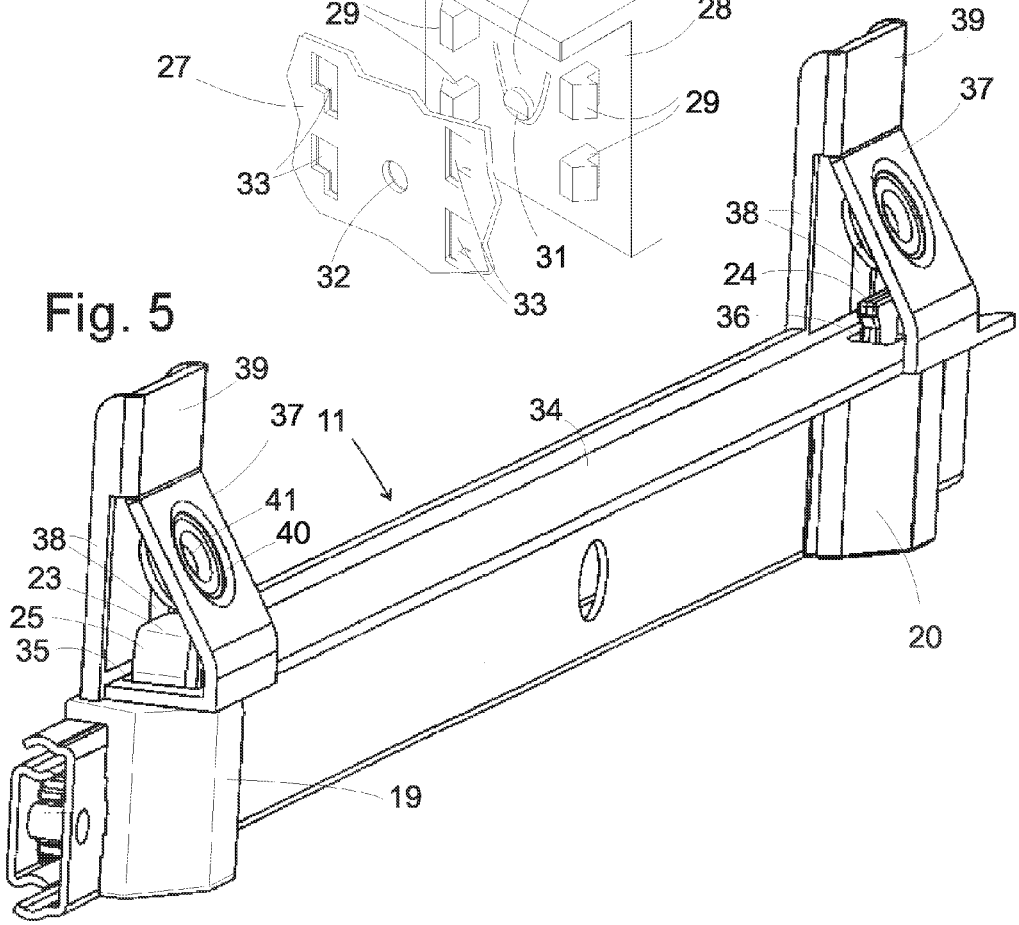
FIG. 5 the telescopic extension from FIG. 3 with a carrier unit mounted on it.

FIG. 5 again shows a perspective view of the telescopic extension 13 from FIG. 3, this time with the carrier part 11 latched into it. The carrier part 11 comprises an elongated base plate 34, which is supported on the upper sides of the adapters 19, 20. On the front end of the base plate 34 is formed a rectangular hole 35 through which the latching element 23 of the adapter 19 is inserted. The sections of the elastic legs 25 of the latching element 23 running downwards towards each other press against the front and the rear edge of the hole 35 and hold the base plate 34 in this way without any play pressed against the adapter 19. The peg 24 of the rear adapter 20 engages in a slit 36 open to the rear of the base plate 34.

Formed at the two ends of the base plate 34, above the hole 35 or the slot 36, is an abutment for the basket of the pull-out container 5. The abutment comprises an angled plate 37 in each case which at its lower edge is connected to an edge of the base plate 34 facing the basket, and which at its upper edge is combined with two vertical bars 38 extending from the base plate 34 into a U-profile section 39. In the middle of the plate 37 is a flat indentation 40 and in the middle of this in turn a hole 41 is formed which extends to the rear side of the plate 37 into a hexagonal cross-section.

Figure 6:
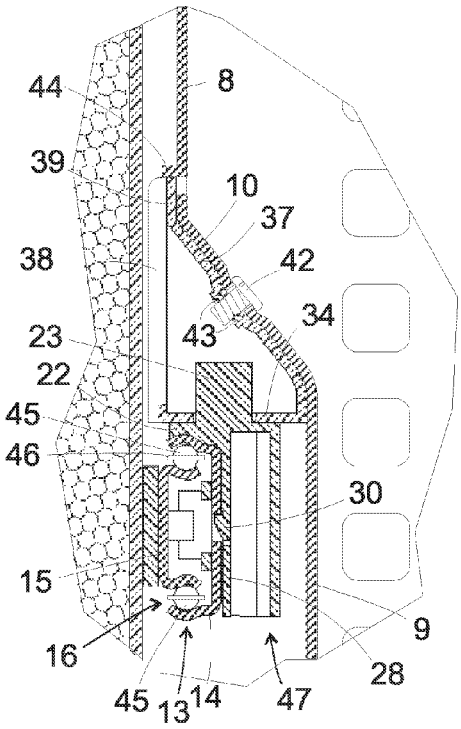
FIG. 6 a section through the telescopic extension of FIGS. 3 and 5 and its surroundings at the height of an adapter.

FIG. 6 shows a section through a telescopic extension and its surroundings at the height of the adapter 19. As this section shows, the hollow space 41 of the plate 37 serves to attach to it with the aid of a screw 42 and nut 43 accommodated to form a close fit in the hexagonal expansion of the hollow space the shoulder 10 of the basket. A lug 44 angled out of the top section 8 of the basket side wall is supported on the upper edge of the U-profile section 39.

Also visible in section are the balls 45 mentioned above, a number of which, guided in a cage 46 in each case, are accommodated in the channels 16 between the rails 14, 15.

The figure also shows that between the outer rails 14 and the lower wall section 9 of the basket lying opposite these is located a space 47, which is partly filled by the hollow base unit of the adapters 19 and 20. The width of this space 47 is greater than that of the telescopic extension 13, so that if need be it is possible to accommodate a second telescopic extension within it, without having to change the dimensions of the pull-out container 5 for this.

It can be seen In FIG. 2 that such an arrangement of two coupled telescopic extensions is provided on each side of the upper pull-out container 4. These coupled telescopic extensions give the pull-out container 4 a freedom of movement which is greater than its depth, so that can be withdrawn completely below a refrigerated goods carrier of the same depth arranged above it, not shown in the figure.

Figure 7:
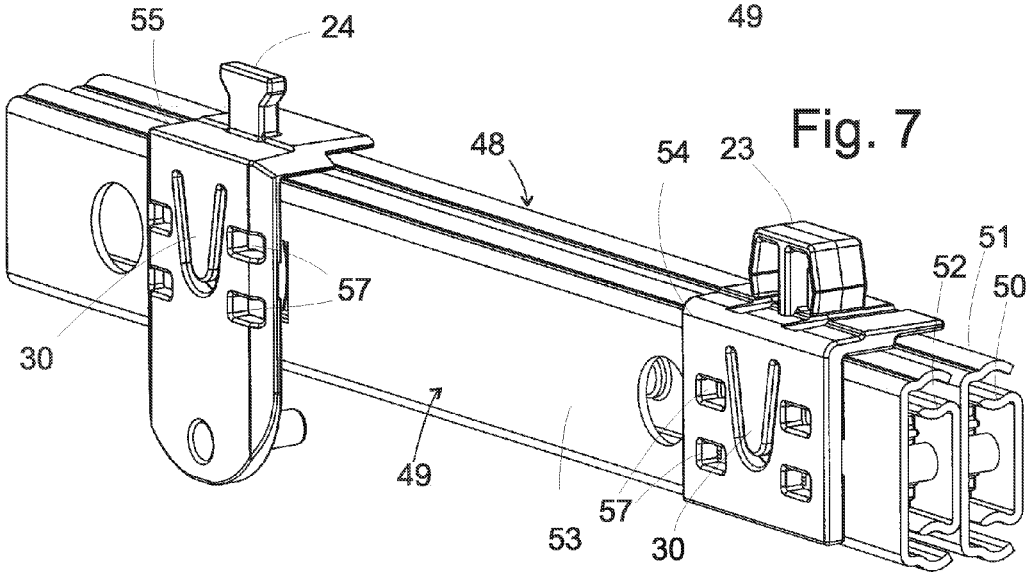
FIG. 7 a perspective view of a combined telescopic extension for the above refrigerated goods carrier from FIG. 2.

FIG. 7 shows a perspective view of two telescopic extensions 48, 49 connected in series on the right-hand side of the pull-out container 4 from the perspective of the user standing in front of the cooling chamber 3. The structure of the telescopic extensions 48, 49 with an inner rail 50 or 52 and an outer rail 51 or 53, which are guided on ball bearings 45 to allow them to move in relation to each other, is the same as with the telescopic extension 13 and does not therefore need to be explained in greater detail. The rails 51, 52 are rigidly connected to each other by the rivets 58 shown in FIG. 10, of which the one or the other can simultaneously act as a stop to delimit the freedom of movement of the extensions 48, 49.

Front and rear adapters 54 or 55 are clamped to the rails 53 in a similar manner to that described above with reference to FIG. 4. Instead of a broad hollow base unit as with the adapters 19, 20 only a narrow plate-type base unit is provided here, on the visible side of which cutouts 57 opposite the elastic tongue 30 and the latching hook 29 are to be seen. The latching elements 23, 24 borne by the adapters 54, 55 are the same as with the adapters 19, 20. Therefore the same type of carrier part 11 as can be seen in FIG. 8, 9, can be fitted to these adapters 54, 55, as has already been explained in relation to FIG. 5.

Figure 8:
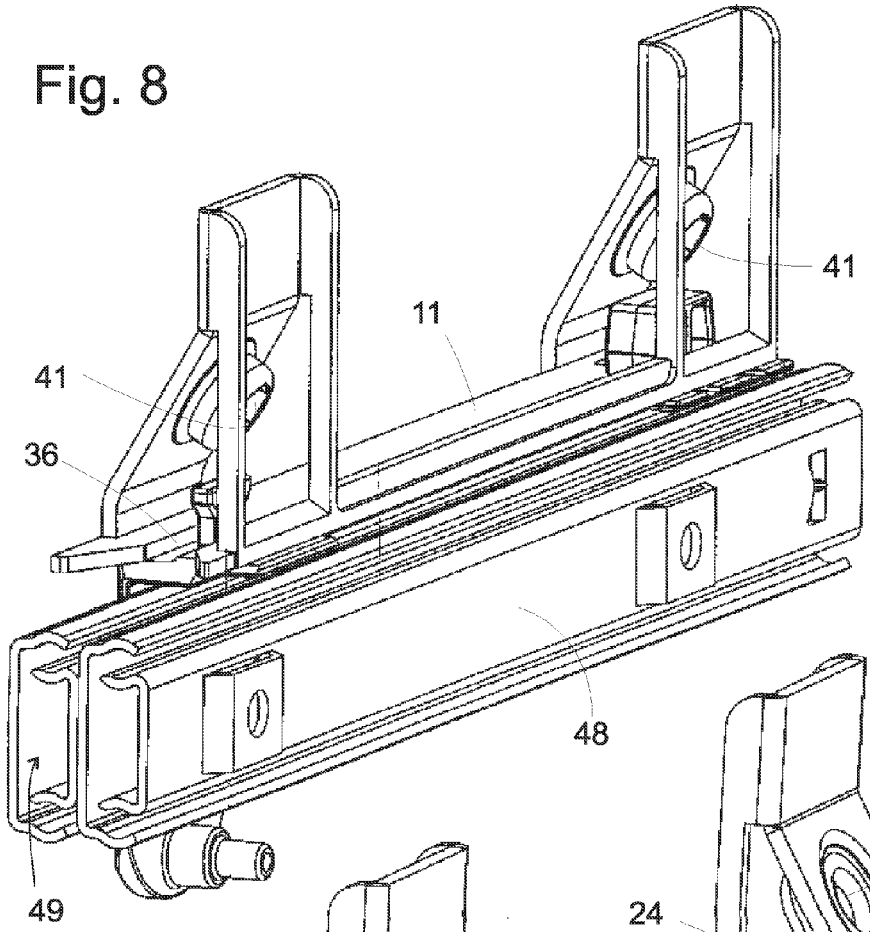
FIG. 8 the combined telescopic extension from FIG. 7 with a carrier section mounted on it viewed from its side facing towards the housing wall.
Figure 9:
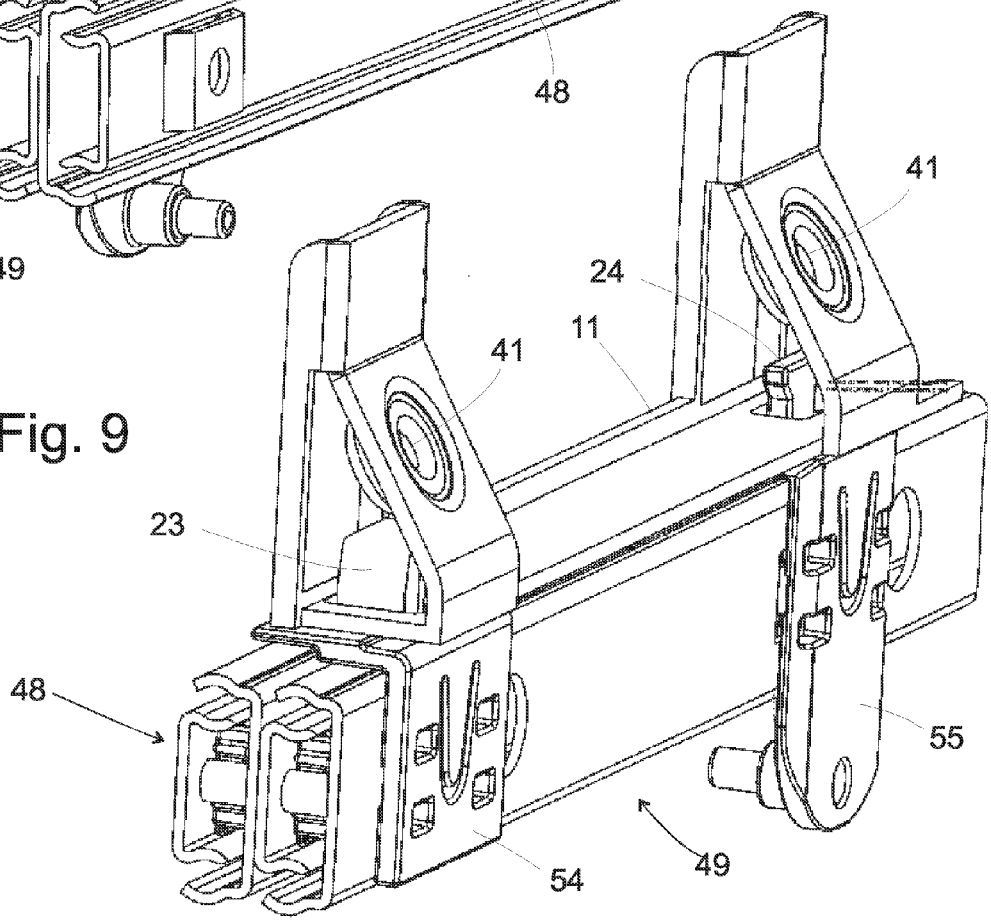
FIG. 9 a perspective view of the combined telescopic extension and of the carrier section, viewed from the cooling chamber of the refrigerator.

In the view depicted in FIG. 8 which shows the side of the telescopic extensions 48, 49 and of the carrier part 11 facing the side wall of the carcass 1, the hexagonal expansion of the holes 41 and slit 36 open backwards towards the rear of the carcass 1 in the base plate 34 of the carrier section 11 can be seen. The slit has edges diverging towards the rear end of the base plate 34, to make it easier to put the slit onto the latching element 24 of the rear adapter.

Figure 10:
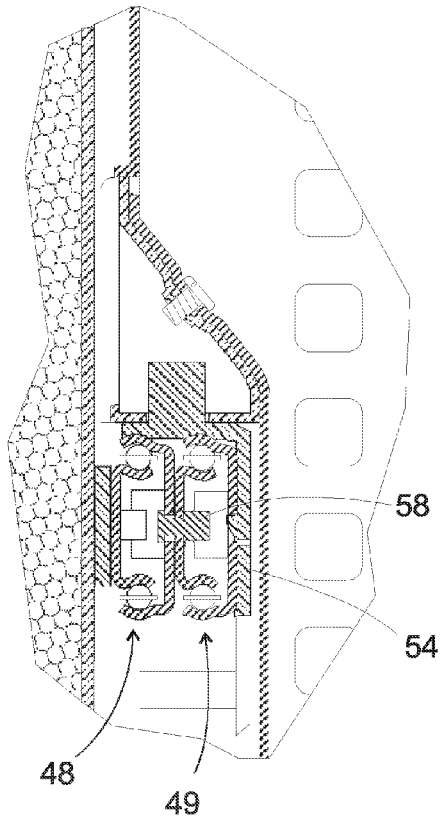
FIG. 10 a section similar to that shown in FIG. 5 through the combined telescopic extension and its surroundings at the height of an adapter.

As can be seen in FIG. 10 the space 47 to the side of the wall section 9 of the basic is practically filled by the additional telescopic extension 49 and plate-type base unit of the adapter 54, 55. The position of the latch protrusions 23 and 24 is the same in relation to the side wall of the chassis or the extension 48 mounted directly on it as shown in FIG. 6, so that identical carrier parts 11 and baskets can be supported as required on a single extension such as 13 or a double extension such as 48, 49.

The invention claimed is:

1. A refrigerator comprising:

a.) a cooling compartment;

b.) a first refrigerated goods carrier movable between an extended disposition in which the first refrigerated goods carrier is extended at least partially out of the cooling compartment and a retracted disposition in which the first refrigerated goods carrier is more fully disposed in the cooling compartment than in the extended disposition;

c.) a pair of telescopic extensions that support the first refrigerated goods carrier for movement between the extended disposition and the retracted disposition, each of the pair of telescopic extensions having a vertical side that is adjacent to a respective vertical side of another of the pair of telescopic extensions and an upper arm extending horizontally away from the vertical side in a direction perpendicular to the vertical side, and the pair of telescopic extensions being movable relative to one another during movement of the first refrigerated goods carrier between the extended disposition and the retracted disposition; and d.) at least one adapter including:

a base unit having a vertical side surface; and a horizontal bar extending from an upper end of the base unit in a direction perpendicular to the vertical side surface of the base unit, the horizontal bar of the at least one adapter disposed on an upper surface of the upper arm of one of the pair of telescopic extensions, the vertical side surface of the at least one adapter abutting the vertical side of the one of the pair of telescopic extensions, the vertical side surface of the at least one adapter including an adapter latching element and the vertical side of the one of the pair of telescopic extensions including a corresponding extension latching element, the adapter latching element being latched with the corresponding extension latching element to secure the at least one adapter to the one of the pair of telescopic extensions, and the at least one adapter disposed between the pair of telescopic extensions and the first refrigerated goods carrier and supporting the first refrigerated goods carrier on the one of the pair of telescopic extensions.

2. The refrigerator as claimed in claim 1, wherein the at least one adapter supports the first refrigerated goods carrier on both of the pair of telescopic extensions.

3. The refrigerator as claimed in claim 1, wherein the base unit of the at least one adapter spans a distance between the first refrigerated goods carrier and the respective telescopic extension adjacent to the first refrigerated goods carrier.

4. The refrigerator as claimed in claim 3, wherein a width of the distance is at least equal to a width of the respective telescopic extension.

5. The refrigerator as claimed in claim 1, wherein the at least one adapter includes at least a pair of top latching elements on an upper surface of the horizontal bar, each of the pair of top latching elements for latching with a respective complementary carrier latching element of the first refrigerated goods carrier.

6. The refrigerator as claimed in claim 1, wherein a freedom of movement of two rails movable in relation to one another of each of the pair of telescopic extensions amounts to less than two thirds of a length of the pair of telescopic extensions.

7. The refrigerator as claimed in claim 1 and further comprising a second refrigerated goods carrier that is held on two sides of the cooling compartment via a second pair of telescopic extensions connected in series on each side respectively and the at least one adapter includes at least one first adapter supporting the first refrigerated goods carrier and at least one second adapter supporting the second refrigerated goods carrier.

8. The refrigerator as claimed in claim 7, wherein the at least one first adapter supporting the first refrigerated goods carrier and the at least one second adapter supporting the second refrigerated goods carrier each include a top latching element operable to be latched with a respective complementary carrier latching element of the respective refrigerated goods carrier and a configuration of the respective complementary carrier latching elements of the first refrigerated goods carrier and the second refrigerated goods carrier are the same.

9. The refrigerator as claimed in claim 8, wherein each of the first refrigerated goods carrier and the second refrigerated goods carrier has a base unit and two carrier parts attached to the base unit, on which the respective complementary carrier latching elements are formed.

10. The refrigerator as claimed in claim 9, wherein the base unit is formed from sheet metal, and the first refrigerated goods carrier and the second refrigerated goods carrier include injection-molded parts.

11. The refrigerator as claimed in claim 1, wherein each of the pair of telescopic extensions includes two rails and the two rails of each of the pair of telescopic extensions are guided by linear ball bearings to allow movement in relation to each other.

12. The refrigerator of claim 1, wherein each of the pair of telescopic extensions includes two rails having a C-shaped cross-section, and the two rails of each of the pair of telescopic extensions are guided by linear ball bearings to allow movement in relation to each other, wherein the horizontal bar of the at least one adapter is disposed on the upper surface of the upper arm of the C-shaped cross-section of the one of the pair of telescopic extensions.

13. The refrigerator as claimed in claim 12, wherein one of the adapter latching element and the corresponding extension latching element includes a latching hook, and the other of the adapter latching element and the corresponding extension latching element includes a corresponding first opening receiving the latching hook, and wherein one of the adapter latching element and the corresponding extension latching element includes an elastic latching element, and the other of the adapter latching element and the corresponding extension latching element includes a corresponding second opening receiving the elastic latching element.

14. A refrigerator comprising:

a.) a cooling compartment;

b.) a first refrigerated goods carrier movable between an extended disposition in which the first refrigerated goods carrier is extended at least partially out of the cooling compartment and a retracted disposition in which the first refrigerated goods carrier is more fully disposed in the cooling compartment than in the extended disposition;

c.) a pair of telescopic extensions that support the first refrigerated goods carrier for movement between the extended disposition and the retracted disposition, each of the pair of telescopic extensions having a side that is adjacent to a respective side of another of the pair of telescopic extensions and the pair of telescopic extensions being movable relative to one another during movement of the first refrigerated goods carrier between the extended disposition and the retracted disposition; and d.) at least one adapter disposed adjacent to a side of the pair of telescopic extensions, the at least one adapter supporting the first refrigerated goods carrier on at least one of the pair of telescopic extensions, wherein the at least one adapter includes at least a pair of latching elements each for latching with a respective complementary latching element of the first refrigerated goods carrier, wherein the pair of latching elements includes a front latching element and a rear latching element, with the rear latching element operable to be latched with the respective complementary latching element of the first refrigerated goods carrier via a movement essentially in parallel to a direction of extension movement of the first refrigerated goods carrier and the front latching element operable to be latched with the respective complementary latching element of the first refrigerated goods carrier via a movement, essentially perpendicular to the direction of extension movement of the first refrigerated goods carrier.

15. The refrigerator as claimed in claim 14, wherein the rear latching element of the adapter is a rigid head and the respective complementary latching element to the rear latching element is a slit of the first refrigerated goods carrier open at edges in the direction of extension movement.

16. The refrigerator as claimed in claim 14, wherein the front latching element of the adapter is a head operable to flexibly deform when the respective complementary latching element is respectively latched or unlatched.

17. The refrigerator as claimed in claim 16, wherein the head of the front latching element has at least one edge flexible in the direction of extension movement, which in a latched state holds the respective complementary latching element of the first refrigerated goods carrier closed against a stop.

18. The refrigerator as claimed in claim 14, wherein the front latching element and the rear latching element are each formed on a front adapter or rear adapter of each of the pair telescopic extensions.

19. The refrigerator as claimed in claim 18, wherein the front adapter and the rear adapter each have a plane of symmetry perpendicular to the direction of extension movement of the first refrigerated goods carrier.

* * * * *

UNITED STATES PATENT AND TRADEMARK OFFICE

CERTIFICATE OF CORRECTION

PATENT NO. : 8,356,865 B2
APPLICATION NO. : 11/918820
DATED : January 22, 2013
INVENTOR(S) : Karl-Friedrich Laible It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1287 days.

Signed and Sealed this
First Day of September, 2015

Michelle K. Lee

Michelle K. Lee
*Director of the United States Patent and Trademark Office*